US009289974B2

(12) United States Patent
González Bruno et al.

(10) Patent No.: US 9,289,974 B2
(45) Date of Patent: Mar. 22, 2016

(54) PRINTHEAD CONTROL SYSTEMS AND METHODS FOR CONTROLLING A PRINTHEAD

(71) Applicant: HEWLETT-PACKARD DEVELOPMENT COMPANY, L.P., Houston, TX (US)

(72) Inventors: Javier González Bruno, Terrassa Barcelona (ES); David Soriano Fosas, Terrassa (ES); Juan Luis López Rodriguez, Subirats Barcelona (ES)

(73) Assignee: HEWLETT-PACKARD DEVELOPMENT COMPANY L.P., Houston, TX (US)

( * ) Notice: Subject to any disclaimer, the term of this patent is extended or adjusted under 35 U.S.C. 154(b) by 0 days.

(21) Appl. No.: 13/872,475

(22) Filed: Apr. 29, 2013

(65) Prior Publication Data

US 2014/0320559 A1 Oct. 30, 2014

(51) Int. Cl.
*B41J 29/38* (2006.01)
*B41J 2/045* (2006.01)

(52) U.S. Cl.
CPC ..... *B41J 2/04501* (2013.01); *B41J 2/0458* (2013.01); *B41J 2/04548* (2013.01)

(58) Field of Classification Search
CPC ..... B41J 2/0457; B41J 2/04548
See application file for complete search history.

(56) References Cited

U.S. PATENT DOCUMENTS

| | | | | |
|---|---|---|---|---|
| 5,130,720 | A * | 7/1992 | Lopez et al. | 347/10 |
| 5,519,417 | A * | 5/1996 | Stephany et al. | 347/57 |
| 5,844,813 | A * | 12/1998 | Tateyama | 347/5 |
| 6,081,280 | A * | 6/2000 | Bolash et al. | 347/9 |
| 6,520,615 | B1 * | 2/2003 | Beck et al. | 347/19 |
| 7,252,355 | B2 | 8/2007 | Umeda | |
| 7,513,585 | B2 | 4/2009 | Nishida | |
| 2002/0062456 | A1 * | 5/2002 | Mariaud et al. | 713/340 |
| 2005/0237354 | A1 * | 10/2005 | Quintana | 347/12 |
| 2007/0080977 | A1 * | 4/2007 | Sato | 347/5 |
| 2008/0074448 | A1 * | 3/2008 | Grandeza et al. | 347/9 |
| 2012/0113175 | A1 | 5/2012 | Lee et al. | |
| 2013/0002746 | A1 | 1/2013 | Takayanagi et al. | |

FOREIGN PATENT DOCUMENTS

WO WO-2011011807 A1 2/2011

OTHER PUBLICATIONS

Lv, W. et al.; "Design and Simulation of Electrostatic Inkjet Head"; Jan. 20-23, 2010; pp. 532-536; http://ieeexplore.ieee.org/stamp/stamp.jsp?tp=&,arnumber=5592454.

* cited by examiner

*Primary Examiner* — Shelby Fidler
(74) *Attorney, Agent, or Firm* — Fabian Van Cott

(57) ABSTRACT

A printhead control system comprises a voltage supply control module to selectively supply an operating voltage to a printhead, and the voltage supply control module is configured to receive a first and a second control voltages, and to disconnect the supply of operating voltage to the printhead at least when the first and second control voltages have the same logical level.

19 Claims, 2 Drawing Sheets

30
10
Vs
40
VctrlA
Vsig
VppLogic
20
VctrlB
M
50
41

30
10
41
Vs
VctrlA
VctrlB
Vsig
VppLogic
20
M
50
42
40

PRINTHEAD CONTROL SYSTEMS AND METHODS FOR CONTROLLING A PRINTHEAD

Inkjet printing apparatus are provided with printheads for firing or spitting drops of ink or other printing fluid. In thermal inkjet printheads, ink may be ejected from a nozzle for example by using a heater resistor: when an electric voltage is applied, electric current flows through the heater resistor, heats the ink and causes it to eject from the nozzle.

In such a system, the printhead is generally supplied with at least two different electric voltages: a logical voltage (e.g. around 5 V) which powers an internal printhead circuitry controlling the spit of the ink, and an operating voltage (e.g. around 30 V) which provides the energy required to spit the ink. These voltages may be applied to the printhead from a digital control module; in particular, the digital control module applies the operating voltage to the printhead through a voltage regulator that stabilizes the voltage level as required for suitable and homogeneous ink firing.

If in such a system the operating voltage is applied to the printhead while the logical voltage is not applied, such that the internal circuitry of the printhead is not operating, the printhead is considered to be in an out of control condition. An uncontrolled ink spit may therefore be generated that may damage the printhead. In order to avoid this risk, when the printhead is powered off during normal operation of the apparatus, the digital control module performs a controlled sequence in which the operating voltage is disconnected from the printhead before the logical voltage.

However, in case of an emergency power down it may occur that the printhead is subject to the operating voltage after the logical voltage drops to zero, thus causing damage to the printhead. This may happen for example if the user simply switches off the apparatus using the power switch, because then the digital control module loses control over the printhead, or also in case of a failure in the digital control module itself.

Such a failure may occur when the digital control module comprises a programmable circuit such as a Field-Programmable Gate Array (FPGA), but may also happen when other devices, such as an Application-Specific Integrated Circuit (ASIC), are employed in the digital control module.

Figure 1:
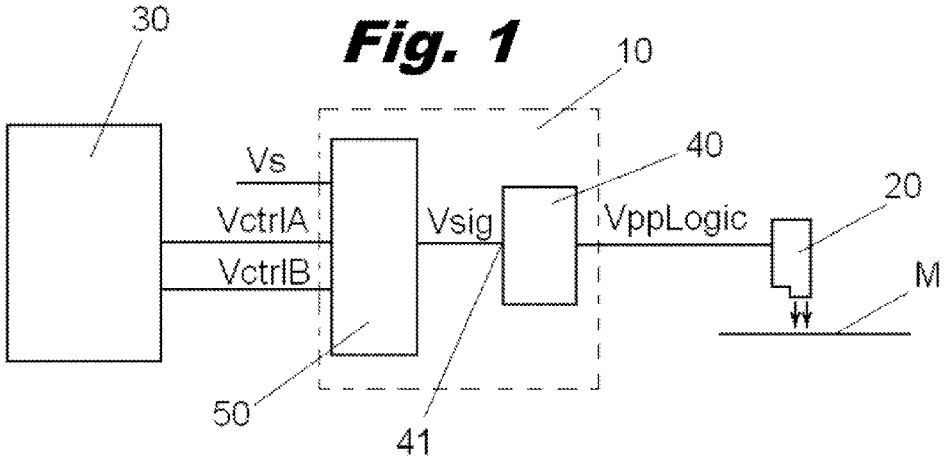
Figure 2:
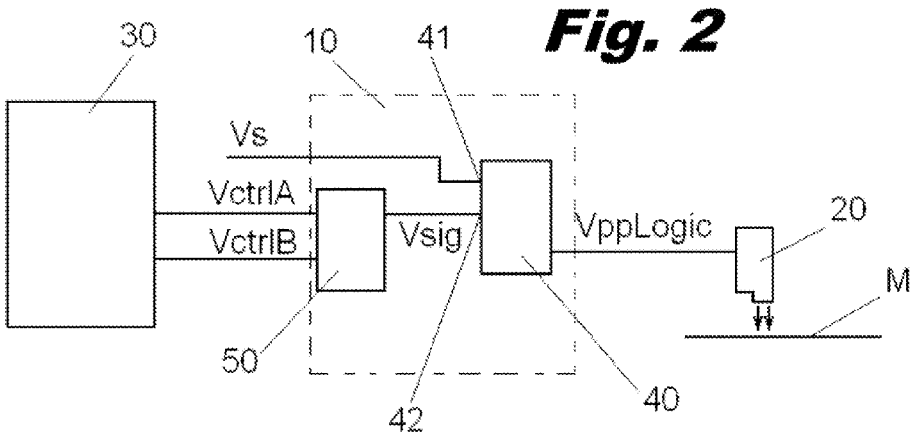
Figure 3:
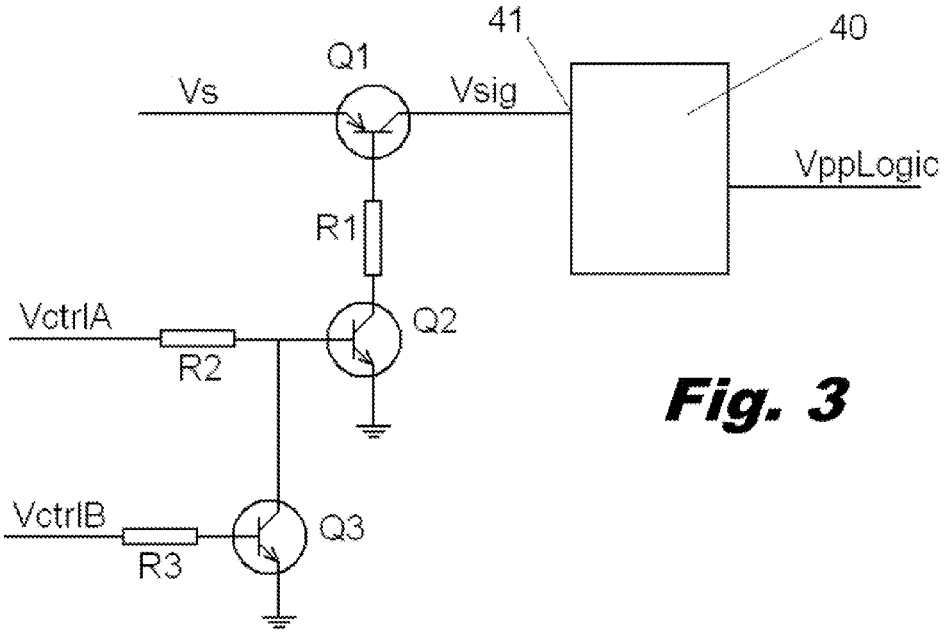
Figure 4:
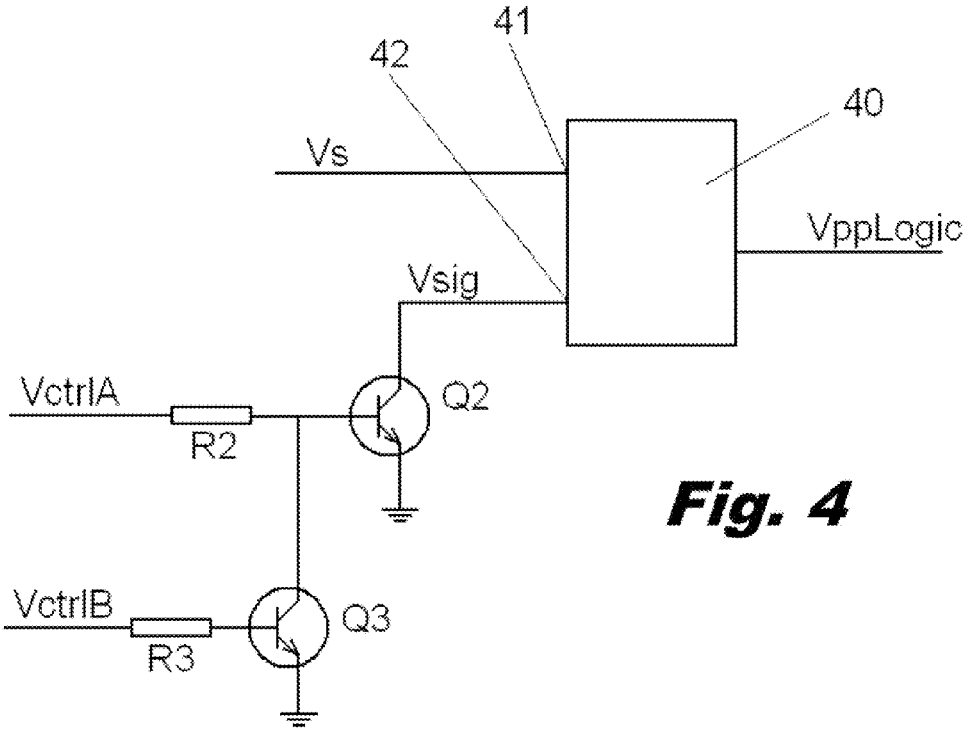

Some non-limiting examples will be described in the following with reference to the appended drawings, in which:

FIG. 1 schematically shows an example of a printhead control system as described herein;

FIG. 2 schematically shows a further example of a printhead control system;

FIG. 3 is a diagram of an example of a circuit for a printhead control system such as that of FIG. 1; and FIG. 4 is a diagram of another example of a circuit for a printhead control system, such as that of FIG. 2.

A printhead, e.g. in an inkjet printing apparatus, may be controlled by a printhead control system which inter alia may generate the required signals and voltages for firing the printhead nozzles.

FIG. 1 shows an example of such a printhead control system, which comprises a voltage supply control module 10, intended to selectively supply an operating voltage VppLogic to a printhead 20. When the operating voltage is supplied to the printhead, this voltage provides a suitable energy for ink spitting, and therefore allows the printhead to fire ink on a print media M.

The operating voltage VppLogic output by the voltage supply control module 10 may be zero (i.e. the supply of operating voltage is disconnected from the printhead 20, and no ink is fired) or may have a non-zero value (i.e. the supply of operating voltage is connected to the printhead 20, and ink may be fired). The value of the operating voltage VppLogic depends on the inputs in voltage supply control module 10.

As visible in FIG. 1, the voltage supply control module 10 may receive a first control voltage VctrlA and a second control voltage VctrlB, and a power supply voltage Vs. The two control voltages VctrlA and VctrlB may be employed to control the functioning of the voltage supply control module, and each may have a logical level, such as logical 1 or logical 0.

Logical 1 and logical 0 may be defined as respectively higher and lower than a predetermined analog voltage threshold, wherein the value of the threshold depends on the hardware implementation.

According to an example, the voltage supply control module 10 is configured to disconnect the supply of operating voltage VppLogic to the printhead 20 at least when the first and second control voltages VctrlA and VctrlB have the same logical level.

By virtue of such a provision, the risk of damage to the printhead in case of a failure in the printhead control system is reduced, as will be explained in the following.

When a digital system is not correctly powered, it may be expected that its outputs are in an uncontrolled state (zero, maximum voltage, or any intermediate voltage), but it is likely that in such a situation all the outputs will be in the same state, i.e. generally at similar analog values and at the same logical level.

Thus, in case of a failure occurring in the printhead control system, involving the loss of control over the functioning of the voltage supply control module 10, it is likely that all the voltages generated by the failing part of the system will remain at about the same level, and therefore at the same logical level. The two control voltages VctrlA and VctrlB received by the voltage supply control module 10 would therefore be at the same logical level, and as a consequence the supply of operating voltage VppLogic to the printhead 20 would be disconnected.

Examples of the printhead control system disclosed herein thus take advantage of the use of two separate control voltages to activate the supply of operating voltage to the printhead, such that only when the two control voltages are at different logical levels the printhead may receive an operating voltage, while in case of a failure in the system the two control voltages would have the same logical level.

It is therefore possible to reduce the risk that the operating voltage VppLogic is applied to the printhead while the internal circuitry of the printhead is not operating.

The voltage supply control module 10 may be configured to connect the supply of operating voltage to the printhead 20 when the first control voltage is higher than a predetermined threshold and the second control voltage is lower than said predetermined threshold, i.e. when the first is at logical level 1 and the second is at logical level 0.

It may additionally be configured to disconnect the supply of operating voltage to the printhead 20 when the first control voltage is lower than said predetermined threshold and the second control voltage is higher than said predetermined threshold, i.e. when the first is at logical level 0 and the second is at logical level 1.

The value of the threshold may depend on the technology and components employed in the system.

The provision of a voltage threshold such that, during normal operation, the connection of the operating voltage VppLogic to the printhead is controlled using two control voltages that have to be opposite with respect to the threshold improves the safety of the system.

In some examples, as shown in FIG. 1, the printhead control system further comprises a digital control module 30 to control the operation of the printhead 20; as shown, the digital control module 30 may provide the first and second control voltages VctrlA and VctrlB to the voltage supply control module 10.

In some examples, the digital control module 30 may be programmable; for example, it may be a Field-Programmable Gate Array (FPGA), or it may be an Application Specific Integrated Circuit (ASIC).

During normal operation of the printhead, the FPGA or other digital control module 30 may provide control voltages as follows: when the supply of operating voltage VppLogic has to be connected to the printhead 20, the digital control provides to the voltage supply control module 10 a first control voltage VctrlA that is higher than a predetermined threshold and a second control voltage VctrlB that is lower than said predetermined threshold.

On the contrary, when during normal operation the supply of operating voltage VppLogic has to be disconnected from the printhead (VppLogic set to zero), the digital control provides to the voltage supply control module 10 a first control voltage VctrlA that is lower than a predetermined threshold and a second control voltage VctrlB that is higher than said predetermined threshold.

It is foreseen that in examples of the printhead control system as explained herein, the operating voltage VppLogic is a regulated operating voltage, such that the printhead 20 receives a voltage which does not suffer from undue oscillations with time.

In some such examples, such as shown in the example of FIG. 1, the voltage supply control module 10 of the printhead control system may comprise a voltage regulator 40 to supply voltage VppLogic as a regulated operating voltage to the printhead 20, and a regulator control module 50 configured to control the output of the voltage regulator 40.

In FIG. 1, for example, the regulator control module 50 is configured to receive first and second regulator control voltages VctrlA and VctrlB and to issue a regulator control signal Vsig towards the voltage regulator 40, which depends on said first and second regulator control voltages VctrlA and VctrlB.

In examples such as that of FIG. 1, the voltage regulator 40 may receive the regulator control signal Vsig in a power voltage inlet 41.

In other examples, such as that shown in FIG. 2, the voltage regulator 40 may receive a supply voltage Vs in a power voltage inlet 41 and the regulator control signal Vsig in an ON/OFF inlet 42.

In examples such as those of FIGS. 1 and 2, the regulator control signal Vsig which is fed by the regulator control module 50 to the voltage regulator 40 may be a voltage disconnection signal if the first and second regulator control voltages VctrlA and VctrlB have the same logical level, such that in this case the output of voltage regulator 40 is zero.

As explained above, this reduces the risk that the operating voltage VppLogic is applied to the printhead in case of a failure in the digital control module 30.

Furthermore, the regulator control signal Vsig may be a voltage connection signal if VctrlA is higher than a predetermined threshold and VctrlB is lower than said threshold. The signal Vsig may be a voltage disconnection signal if VctrlA is lower than a predetermined threshold and VctrlB is higher than said threshold.

If both VctrlA and VctrlB have the same voltage level above or below the threshold, including any intermediate voltage between a maximum and minimum possible voltages, and therefore they are at the same logical level, a voltage disconnection signal is fed to the voltage regulator 40.

In examples such as that of FIG. 1, the regulator control signal Vsig outputted by the regulator control module 50 may be zero, thus being a disconnection signal because VppLogic will then also be zero and the supply of operating voltage will be disconnected from the printhead 20; or it may be a non-zero voltage, thus being a connection signal because VppLogic will then also be a non-zero voltage and it will be connected to the printhead 20.

In examples such as that of FIG. 2, the regulator control signal Vsig outputted by the regulator control module 50 may simply be a 1/0 signal, to switch ON or OFF the voltage regulator 40 and therefore connect or disconnect the supply of the operating voltage VppLogic to/from the printhead 20.

FIG. 3 is a diagram showing an example of a regulator control module for a system such as that described in relation to FIG. 1.

In such a circuit, the regulator control module may comprise transistors Q1, Q2 and Q3, wherein transistor Q1 is controlled directly by the activation of Q2, which depends on the two regulator control signals VctrlA and VctrlB outputted from the digital control module 30 (FIG. 1). The output of Q1 towards the power voltage inlet 41 of voltage regulator 40 is a regulator control signal Vsig which is either Vs, when Q2 is activated, or zero, when Q2 is not activated.

In the circuit shown in FIG. 3, a first regulator control signal VctrlA may be applied to the base of Q2, and a second regulator control signal VctrlB may be applied to the base of Q3. The collector of Q3 is connected to the base of Q2, and the collector of Q2 is connected to the base of Q1. The emitter of the Q1 is connected to a supply voltage Vs, and its collector is connected to the inlet 41 of the voltage regulator 40.

The voltage threshold in this case may be 0.7 V, due to the transistor technology employed, because the ON/OFF state of the transistors depends on whether the voltage at their bases is above or below this value.

To turn ON the transistor Q2, and therefore Q1, the voltage at the base of Q2 must be higher than 0.7 V (logical level 1), so VctrlA must be higher than 0.7 V. However, if VctrlB is also higher than 0.7 V, transistor Q3 will be ON, the voltage at the collector of Q3 will be zero, and as a consequence the voltage at the base of Q2 will also be zero, turning OFF Q2 and Q1.

As a consequence, in order to turn ON transistor Q1, and therefore have a Vsig=Vs input to voltage regulator 40 and the connection of voltage VppLogic to the printhead 20, the first regulator control voltage VctrlA must be higher than the threshold 0.7 V (logical level 1), and the second regulator control voltage VctrlB must be lower than the threshold 0.7 V (logical level 0). This may correspond to a situation of a correct ON state, i.e. a situation in which the printhead 20 is connected to a voltage VppLogic in order to allow firing.

If VctrlB is higher than 0.7 V and Vctrl A is lower than 0.7 V, the voltage at the base of Q2 will be zero, and Q2 and Q1 will be OFF. This may correspond to a situation of a correct OFF state, i.e. a situation in which the printhead 20 is not connected to a voltage (i.e. connected to a voltage zero) because it doesn't have to fire.

If VctrlA and VctrlB have the same logical level, the voltage at the base of Q2 will be zero: indeed, if they are both higher than 0.7 V (logical level 1), VctrlB forces a zero at the base of Q2, and if they are both lower than 0.7 V (logical level 0), VctrlA forces a zero at the base of Q2. This may correspond to a situation in which the digital control system 30 has failed, and as a consequence its outputs VctrlA and VctrlB remain at the same logical level.

The following table summarizes the operation of the circuit of FIG. 3.

| VctrlA | VctrlB | Q2 base | Q2 and Q1 | Vsig | output to printhead 20 | status |
|---|---|---|---|---|---|---|
| <0.7 V | <0.7 V | <0.7 V | OFF | 0 | 0 | fail |
| >0.7 V | <0.7 V | >0.7 V | ON | Vs | VppLogic | correct ON |
| <0.7 V | >0.7 V | <0.7 V | OFF | 0 | 0 | correct OFF |
| >0.7 V | >0.7 V | <0.7 V | OFF | 0 | 0 | fail |

As visible also from the table, the risk of uncontrolled firing in case of failure of the digital control module 30 may be reduced, no matter the voltage (between a maximum and minimum possible voltages) at which the regulator control voltages VctrlA and VctrlB remain set after failure, because they will generally be at the same logical level.

FIG. 4 is a diagram showing an example of a regulator control module for a system such as that described in relation to FIG. 2.

In this case the voltage regulator 40 comprises an ON/OFF inlet or terminal 42, apart from the voltage inlet 41, and the transistor Q1 of FIG. 3 may be omitted.

In the example of FIG. 4, the regulator control signal Vsig which is fed to terminal ON/OFF 42 of voltage regulator 40 may be zero or may be a non-zero voltage, depending on the values of the regulator control voltages VctrlA and VctrlB, as summarized in the following table.

| VctrlA | VctrlB | Q2 base | Q2 | Vsig | output to printhead 20 | status |
|---|---|---|---|---|---|---|
| <0.7 V | <0.7 V | <0.7 V | OFF | 0 | 0 | fail |
| >0.7 V | <0.7 V | >0.7 V | ON | ≠0 | VppLogic | correct ON |
| <0.7 V | >0.7 V | <0.7 V | OFF | 0 | 0 | correct OFF |
| >0.7 V | >0.7 V | <0.7 V | OFF | 0 | 0 | fail |

Different technologies, such as logical gates or others, may also be employed instead of transistors such as shown in the examples of FIGS. 3 and 4.

Also disclosed herein is an inkjet printing apparatus comprising a printhead control system as described above.

An example of a method for controlling a printhead 20 may comprise: generating a first control voltage VctrlA and a second control voltage VctrlB to control the supply of an operating voltage VppLogic to the printhead 20; and disconnecting the supply of operating voltage VppLogic to the printhead 20 at least when the first and second control voltages VctrlA and VctrlB have the same logical level.

In some examples of the method, for example as described in relation to FIGS. 3 and 4 above, the operating voltage VppLogic is supplied to the printhead 20, in order to allow firing, when the first control voltage is higher than a predetermined threshold and the second control voltage VctrlB is lower than said threshold; the supply of operating voltage VppLogic may be disconnected from the printhead when the first control voltage VctrlA is lower than the predetermined threshold and the second control voltage VctrlB is higher than said threshold, in order to prevent firing during normal printing operations.

According to some examples, the first and second control voltages VctrlA and VctrlB may be generated by a digital control module 30, which is provided to control the operation of the printhead, and received by a voltage supply control module 10 which is provided to selectively supply an operating voltage VppLogic to the printhead under the control of said digital control module 30.

Thus, the digital control module 30 controls the connection and disconnection of voltage VppLogic to the printhead 20 by means of the two control voltages VctrlA and VctrlB. Failure of the module 30 may cause that all its outputs, including VctrlA and VctrlB, are left at the same logical level: in such a case the supply of operating voltage VppLogic may be disconnected from the printhead. The risk of damage to the printhead 20 due to uncontrolled firing may therefore be reduced.

Although only a number of particular embodiments and examples have been disclosed herein, further variants and modifications of the disclosed print media products are possible; other combinations of the features of embodiments or examples described are also possible. Reference signs related to drawings and placed in parentheses in a claim, are solely for attempting to increase the intelligibility of the claim, and shall not be construed as limiting the scope of the claim. Thus, the scope of the present invention should not be limited by particular examples or embodiments, but should be determined only by a fair reading of the claims that follow.

What is claimed is:

1. A printhead control system, comprising:

a voltage supply control module to selectively supply an operating voltage to a printhead;

wherein the voltage supply control module:

receives a first and a second control voltages; and detects when a control voltage becomes uncontrolled; and upon detection of an uncontrolled control voltage, disconnects the supply of operating voltage to the printhead in every instance wherein the first and second control voltages have the same logical level, wherein, during normal operation, the first and second control voltages have different voltages and different logic values.

2. A printhead control system as claimed in claim 1, wherein the voltage supply control module connects the supply of operating voltage to the printhead when the first control voltage is higher than a predetermined threshold and the second control voltage is lower than said predetermined threshold.

3. A printhead control system as claimed in claim 2, wherein the voltage supply control module disconnects the supply of operating voltage to the printhead when the first control voltage is lower than said predetermined threshold and the second control voltage is higher than said predetermined threshold.

4. A printhead control system as claimed in claim 1, further comprising a digital control module to control the operation of the printhead, said digital control module providing said first and second control voltages to the voltage supply control module.

5. A printhead control system as claimed in claim 4, wherein said digital control module, during normal operation of the printhead, provides a first control voltage that is higher than a predetermined threshold and a second control voltage that is lower than said predetermined threshold, if the supply of operating voltage to the printhead has to be connected.

6. A printhead control system as claimed in claim 5, wherein said digital control module, during normal operation of the printhead, provides a first control voltage that is lower than said predetermined threshold and a second control voltage that is higher than said predetermined threshold, if the supply of operating voltage to the printhead has to be disconnected.

7. A printhead control system as claimed in claim 1, wherein said voltage supply control module comprises a voltage regulator to supply a regulated operating voltage to the printhead, and a regulator control module to control the output of said voltage regulator.

8. A printhead control system as claimed in claim 7, wherein said regulator control module receives said first and second control voltages and to issue a regulator control signal towards the voltage regulator, said voltage control signal depending on said first and second control voltages.

9. A printhead control system as claimed in claim 8, wherein the voltage regulator receives said signal in a power voltage inlet.

10. A printhead control system as claimed in claim 8, wherein the voltage regulator receives said signal in an ON/OFF inlet and to receive a supply voltage in a power voltage inlet.

11. A printhead control system as claimed in claim 8, wherein said regulator control module issues a voltage disconnection signal as said regulator control signal, if the first and second control voltages have the same logical level.

12. A printhead control system as claimed in claim 11, wherein said regulator control module issues a voltage connection signal as said regulator control signal, if the first control voltage is higher than a predetermined threshold and the second control voltage is lower than said predetermined threshold.

13. A printhead control system as claimed in claim 12, wherein said regulator control module issues a voltage disconnection signal as said regulator control signal, if the first control voltage is lower than said predetermined threshold and the second control voltage is higher than said predetermined threshold.

14. A printhead control system as claimed in claim 1, wherein an uncontrolled control voltage is detected by the first and second control voltages sharing the same logic value.

15. A method for controlling a printhead, comprising:

generating a first control voltage and a second control voltage to control the supply of an operating voltage to the printhead, and when loss of control over the functioning of a voltage supply control module controlling a supply of operating voltage to the printhead as indicated when the first and second control voltages both signal a logical 1 or when the first and second control voltages both signal a logical 0 occurs, disconnecting the supply of operating voltage to the printhead.

16. A method as claimed in claim 15, comprising supplying the operating voltage to the printhead when the first control voltage is higher than a predetermined threshold and the second control voltage is lower than said predetermined threshold.

17. A method as claimed in claim 16, comprising disconnecting the supply of operating voltage to the printhead when the first control voltage is lower than said predetermined threshold and the second control voltage is higher than said predetermined threshold.

18. A method as claimed in claim 15, wherein said first and second control voltages are generated by a digital control module provided to control the operation of the printhead, and received by a voltage supply control module provided to selectively supply an operating voltage to the printhead under the control of said digital control module.

19. An inkjet printing apparatus comprising:

a voltage supply control module to selectively supply an operating voltage to a printhead;

wherein the voltage supply control module:

receives a first and a second control voltages;

detects when a control voltage becomes uncontrolled; and disconnects the supply of operating voltage to the printhead in every instance wherein the first and second control voltages have the same logical level;

wherein during normal operation, the first and second control voltages have different voltages and different logic values, and wherein the voltage supply control module further:

upon detection of an uncontrolled control voltage, disconnects the supply of operating voltage to the printhead.

* * * * *